US012276480B2

(12) United States Patent
Elpedes et al.

(10) Patent No.: US 12,276,480 B2
(45) Date of Patent: Apr. 15, 2025

(54) OPTICAL SIGHT MOUNTING SYSTEM

(71) Applicant: Trijicon, Inc., Wixom, MI (US)

(72) Inventors: Jerry Glen S. Elpedes, Milford, MI (US); Matthew Stephen Bindon, Walled Lake, MI (US)

(73) Assignee: Trijicon, Inc., Wixom, MI (US)

( * ) Notice: Subject to any disclaimer, the term of this patent is extended or adjusted under 35 U.S.C. 154(b) by 241 days.

(21) Appl. No.: 18/080,522

(22) Filed: Dec. 13, 2022

(65) Prior Publication Data

US 2024/0191972 A1 Jun. 13, 2024

(51) Int. Cl.
*F41G 11/00* (2006.01)
*F41G 1/30* (2006.01)

(52) U.S. Cl.
CPC ..... *F41G 11/001* (2013.01); *F41G 1/30* (2013.01)

(58) Field of Classification Search
CPC . F41G 1/30; F41G 1/387; F41G 11/00; F41G 11/001; F41G 11/002; F41G 11/003; F41G 11/004; F41G 11/005; F41G 11/006; F41G 11/007; F41G 11/008
See application file for complete search history.

(56) References Cited

U.S. PATENT DOCUMENTS

| | | | | |
|---|---|---|---|---|
| 1,362,320 | A | 12/1920 | Joeck | |
| 2,743,525 | A | 5/1956 | Leupold | |
| 12,173,985 | B1 * | 12/2024 | Wu | F41G 1/30 |
| 2006/0010758 | A1 | 1/2006 | Zeh | |
| 2007/0113462 | A1 | 5/2007 | Ho | |
| 2015/0241174 | A1 | 8/2015 | Silvennoinen | |
| 2017/0059277 | A1 * | 3/2017 | Justice | F41G 11/003 |
| 2018/0195835 | A1 * | 7/2018 | Crispin | F41G 1/30 |
| 2020/0025516 | A1 * | 1/2020 | Mok | F41G 1/30 |
| 2020/0232762 | A1 | 7/2020 | Hamilton et al. | |
| 2022/0026175 | A1 * | 1/2022 | Chavez | F41G 1/30 |

(Continued)

FOREIGN PATENT DOCUMENTS

| | | | | |
|---|---|---|---|---|
| AT | 513509 B1 * | 5/2014 | | F41G 1/22 |
| CN | 108317898 A | 7/2018 | | |
| DE | 723468 | 8/1942 | | |

(Continued)

OTHER PUBLICATIONS

Review: Aimpoint Acro. Poole. <https://www.gunsandammo.com/editorial/review-aimpoint-acro/329540>. Dec. 12, 2018. (Year: 2018).*

(Continued)

*Primary Examiner* — Gabriel J. Klein
(74) *Attorney, Agent, or Firm* — Harness, Dickey & Pierce, P.L.C.

(57) ABSTRACT

An optical sight includes a housing and an optical element supported by the housing. The housing includes a first surface defining a cavity accessible from a first cavity side of the housing and a bottom side of the housing and an opening extending along a longitudinal axis of the housing. The first surface is configured such that the first cavity is inaccessible from above. The first cavity is configured to accommodate a first fastener such that a head of the first fastener is supported by the first surface and such that a shaft of the first fastener extends through the bottom side of the housing. The optical element is disposed within the opening of the housing.

16 Claims, 7 Drawing Sheets

(56) References Cited

U.S. PATENT DOCUMENTS

| | | | | |
|---|---|---|---|---|
| 2022/0034631 | A1* | 2/2022 | Rosen | F41G 1/30 |
| 2023/0332865 | A1* | 10/2023 | Wells | F41G 1/30 |

FOREIGN PATENT DOCUMENTS

| | | | | |
|---|---|---|---|---|
| DE | 723468 | C | | 8/1942 |
| EP | 0715989 | A1 | | 6/1996 |
| JP | 1996187225 | | | 7/1996 |
| JP | 2022517661 | A | | 3/2022 |
| KR | 1020020039423 | A | | 5/2002 |
| KR | 20160041100 | A | * | 4/2016 |
| WO | 2013-003873 | A1 | | 1/2013 |

OTHER PUBLICATIONS

Office Action for corresponding Japanese Application No. 2023-183999 dated Dec. 17, 2024, with English translation. (8 pages).
Office Action for corresponding Sweden Application No. 2351405-2 dated Jun. 5, 2024 (9 pages).
Office Action for corresponding German Application No. 1020231331973 dated Jul. 30, 2024 (11 pages).
Combined Search and Examination Report for corresponding Patent Application No. GB2319043.2 dated Apr. 30, 2024 (5 Pages).

* cited by examiner

OPTICAL SIGHT MOUNTING SYSTEM

FIELD

The present disclosure relates to an optical sight, and, more specifically, to a system for mounting an optical sight to a firearm.

BACKGROUND

This section provides background information related to the present disclosure which is not necessarily prior art.

Firearms conventionally incorporate a sight to aid in aligning a trajectory of the firearm with a target. In one configuration, the sight includes a front sight in the form of an upwardly extending bead or post fixed proximate to the muzzle end of a barrel of the firearm, and a rear sight in the form of a raised block having a U or V-shaped notch formed therein. By aligning the front and rear sights, an operator of the firearm may properly align the firearm relative to a target.

In another configuration, the sight includes an optical element that displays an illuminated reticle for use in aligning a barrel of a firearm with a target. One such sight is disclosed in U.S. Pat. No. 8,215,050. The foregoing optical sight incorporates an optical element, which receives light from a light source and displays a reticle (e.g., a red dot) on a lens for use by an operator in aligning a barrel of a firearm with a target. Such a sight incorporating a lens and an illuminated reticle is generally an improvement over mechanical sights, as the illuminated reticle of the optical sight may be viewed from numerous angles from the rear of the firearm and does not have to be exactly aligned with an eye of the operator. Allowing the reticle to be viewed from numerous angles from behind the firearm allows the operator to be positioned somewhat offset from a longitudinal axis of the firearm while still maintaining the barrel of the firearm trained on a target.

Optical sights are typically secured to a firearm, or to a mount that is secured to a firearm, by one or more fasteners. The one or more fasteners are typically tightened by a tool, such as a screwdriver. This requires the operator to approach the fastener from above to rotate the head of the fastener. Therefore, optical sights typically are designed to allow space above the fasteners to be unobstructed so an operator may properly secure the fasteners to the firearm or the mount. Because of this need for space above the fasteners in typical optical sights, the size and configuration of the optical sight may be limited. Alternatively, optical sights including a larger optics train may require a larger housing to allow access to the fasteners while housing the larger optics train.

In order to minimize the total size of optical sights as described above, the light source displaying the reticle may be placed in a position such that the light source is not within a housing of the optical sight and thus, may be exposed to the environment in which the firearm is being used. Such environments may expose the optical sight to various forms of debris, such as sand, dirt, or water, which may diminish the effectiveness of the light source and may damage the light source.

Based on the foregoing, an optical sight incorporating the light source within the housing while minimizing the total size of the optical sight is desirable in the industry. This may be accomplished, for example, by a housing of the optical sight which allows the fasteners to be tightened by a tool from a side of the housing or by an operator accessing the fasteners from a side of the housing.

SUMMARY

This section provides a general summary of the disclosure, and is not a comprehensive disclosure of its full scope or all of its features.

An aspect of the present disclosure provides an optical sight including a housing and an optical element supported by the housing. The housing includes a first surface defining a cavity accessible from a first cavity side of the housing and a bottom side of the housing and an opening extending along a longitudinal axis of the housing. The first surface is configured such that the first cavity is inaccessible from above. The first cavity is configured to accommodate a first fastener such that a head of the first fastener is supported by the first surface and such that a shaft of the first fastener extends through the bottom side of the housing. The optical element is disposed within the opening of the housing.

In some configurations of the optical sight of the above paragraph, the first cavity is configured such that the head of the first fastener is accessible from the first cavity side of the housing when the first fastener is placed within the first cavity.

In some configurations of the optical sight of either of the above paragraphs, the head of the first fastener defines a first aperture on a first side of the head of the first fastener.

In some configurations of the optical sight of any of the above paragraphs, the head of the first fastener defines a second aperture on a second side of the head of the first fastener. The second side of the head of the first fastener is opposite the first side of the head of the first fastener.

In some configurations of the optical sight of any of the above paragraphs, a portion of the housing separates the first cavity from the opening of the housing.

In some configurations of the optical sight of any of the above paragraphs, the first cavity is configured such that a top surface of the head of the first fastener is inaccessible from above when the first fastener is placed in the first cavity.

In some configurations of the optical sight of any of the above paragraphs, the housing further includes a second surface defining a second cavity accessible from a second cavity side of the housing and the bottom side of the housing. The second surface is configured such that the second cavity is inaccessible from above. The second cavity is configured to accommodate a second fastener such that a head of the second fastener is supported by the second surface and such that a shaft of the second fastener extends through the bottom side of the housing. The second cavity side of the housing is any of the first cavity side of the housing and a second side of the housing.

In some configurations of the optical sight of any of the above paragraphs, the second cavity is configured such that the head of the second fastener is accessible from the second cavity side of the housing when the second fastener is placed within the second cavity.

In some configurations of the optical sight of any of the above paragraphs, the head of the second fastener defines a first aperture on a first side of the head of the second fastener.

In some configurations of the optical sight of any of the above paragraphs, the head of the second fastener includes a second aperture on a second side of the head of the second fastener. The second side of the head of the second fastener is opposite the first side of the head of the second fastener.

In some configurations of the optical sight of any of the above paragraphs, the second side of the housing is opposite the first cavity side of the housing.

In some configurations of the optical sight of any of the above paragraphs, a portion of the housing separates the second cavity from the opening of the housing.

In some configurations of the optical sight of any of the above paragraphs, the second cavity is configured such that a top surface of the head of the second fastener is inaccessible from above when the second fastener is placed in the second cavity.

In some configurations of the optical sight of any of the above paragraphs, the optical sight further comprises a reticle displayed on the optical element.

In some configurations of the optical sight of any of the above paragraphs, the reticle is provided by a light source.

In some configurations of the optical sight of any of the above paragraphs, the light source is disposed within the opening.

Another aspect of the present disclosure provides a method of mounting an optical sight to a base including inserting a threaded shaft of a first fastener into a first threaded bore of the base, inserting the first fastener into a first cavity of a housing of the optical sight through a first fastener opening on a first side of the housing, and rotating a head of the first fastener such that rotating the head of the first fastener tightens the first fastener in the first threaded bore. The head of the first fastener is supported by a first surface defining the first cavity and the threaded shaft of the first fastener extends through the first fastener opening on a bottom side of the housing when the first fastener is inserted into the first cavity. The first cavity is configured such that the first fastener is inaccessible from above when inserted into the first cavity.

In some configurations of the method of mounting the optical sight to the base of the above paragraph, the method further includes inserting a tool into an aperture of a side of the head of the first fastener and rotating the head of the first fastener with the tool.

In some configurations of the method of mounting the optical sight to the base of either of the above paragraphs, the method further includes inserting a second fastener into a second cavity of the housing of the optical sight through a second fastener opening on a second side of the housing, inserting the threaded shaft of the second fastener into a second threaded bore of the base, and rotating a head of the second fastener such that rotating the head of the second fastener tightens the second fastener in the second threaded bore. The head of the second fastener is supported by a second surface defining the second cavity and a threaded shaft of the second fastener extends through the second fastener opening on the bottom side of the housing when the second fastener is inserted into the second cavity. The second cavity is configured such that the second fastener is inaccessible from above when inserted into the second cavity.

In some configurations of the method of mounting the optical sight to the base of any of the above paragraphs, the method further includes inserting a tool into an aperture of a side of the head of the second fastener and rotating the head of the second fastener with the tool.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
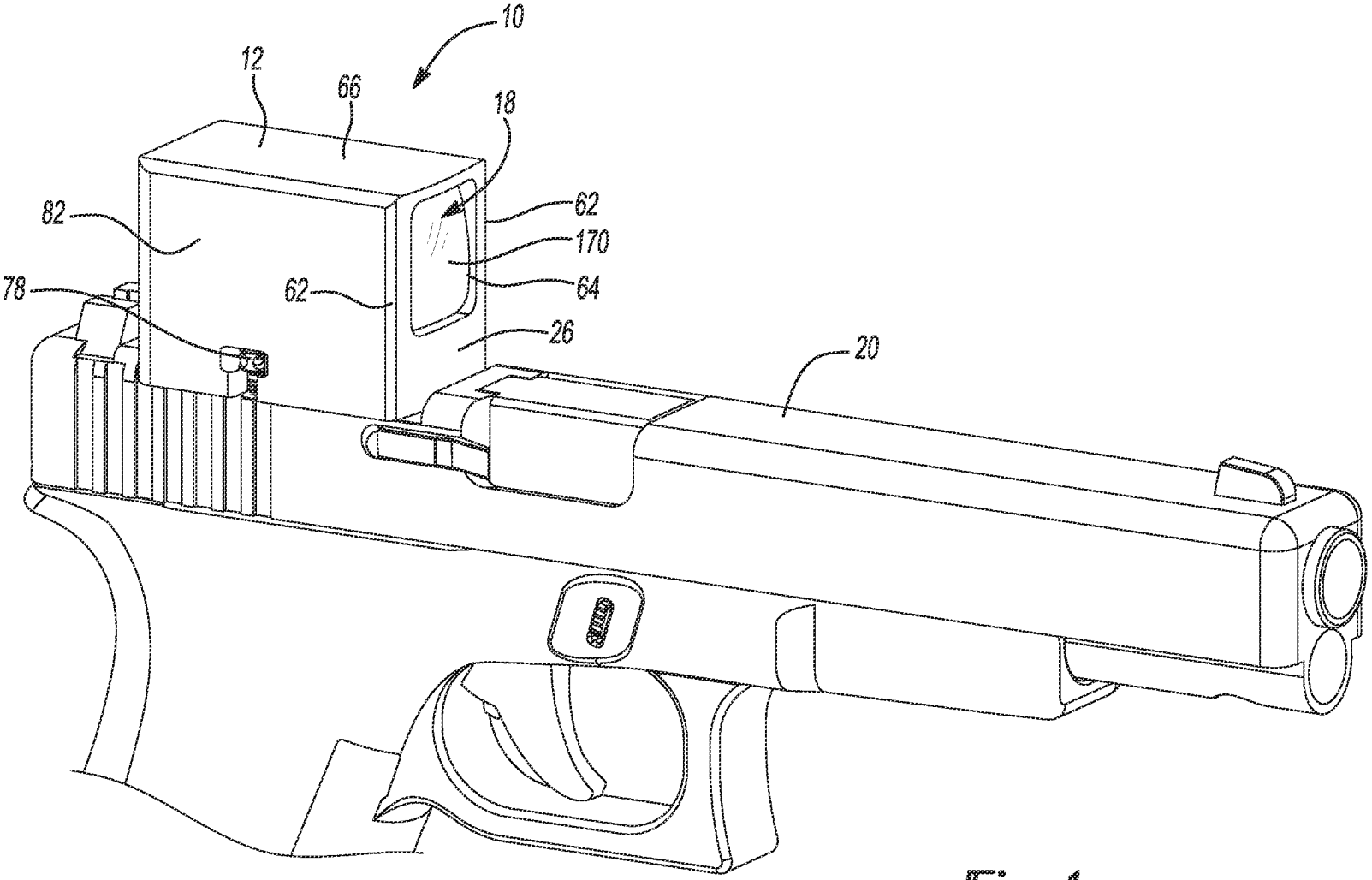
FIG. 1 is a perspective view of an example firearm including an optical sight according to the present disclosure.
Figure 7:
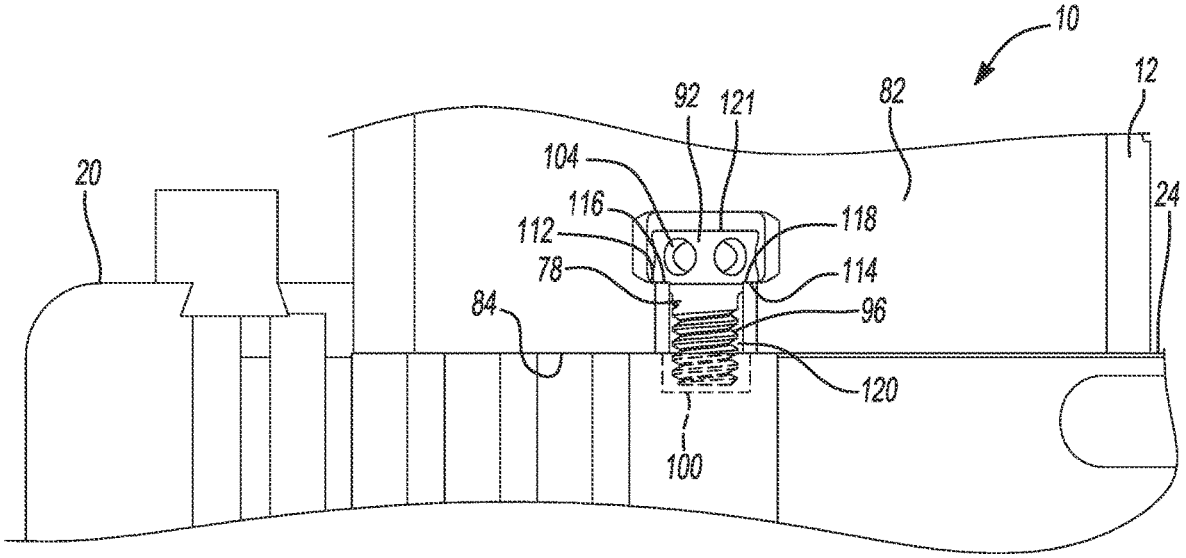

FIG. 7 a detail view of the fastener securing the optical sight to the firearm as shown in FIG. 1.

Figure 2:
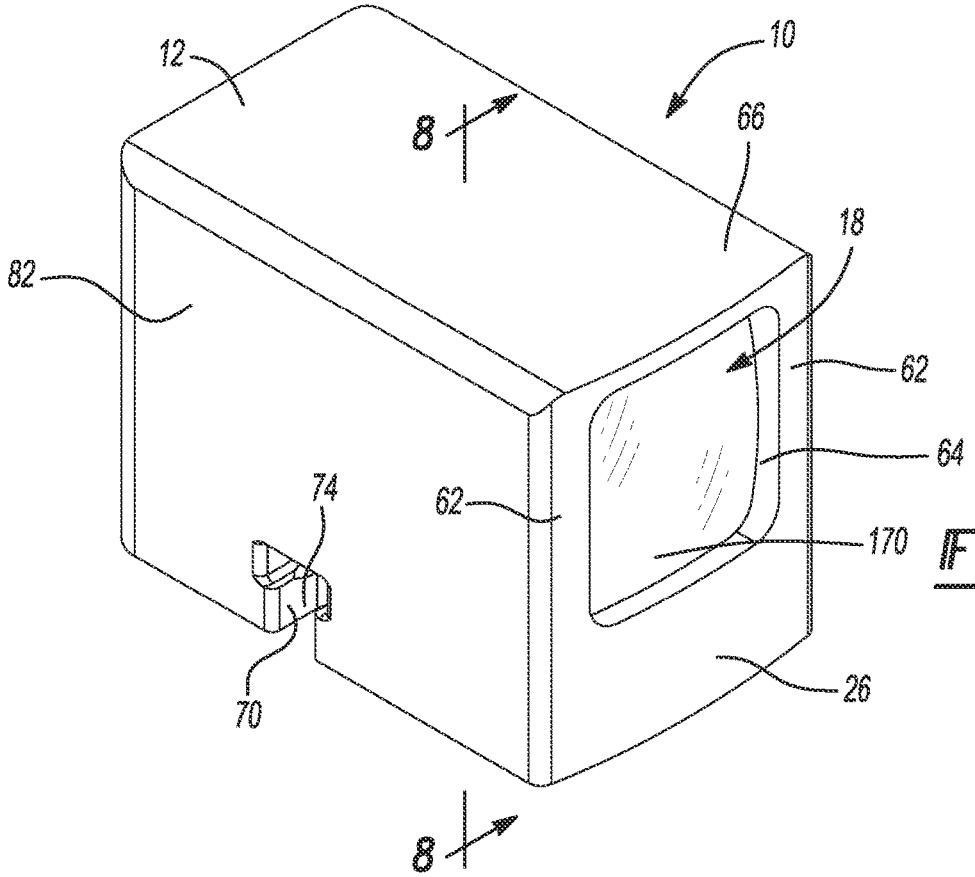
FIG. 2 is a perspective view of an example optical sight according to the present disclosure.
Figure 8:
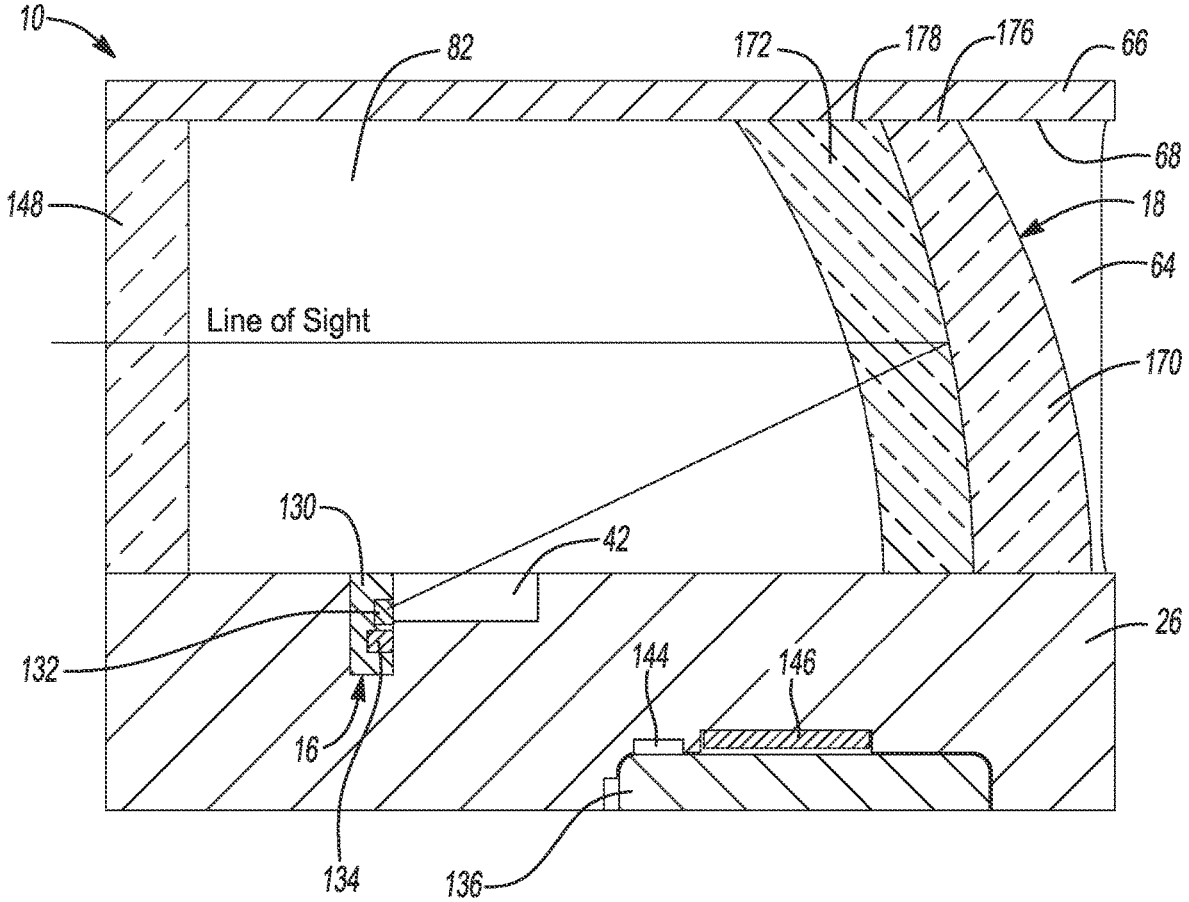

FIG. 8 is a cross-sectional view of the optical sight in FIG. 2 taken along line 8-8.

Figure 5:
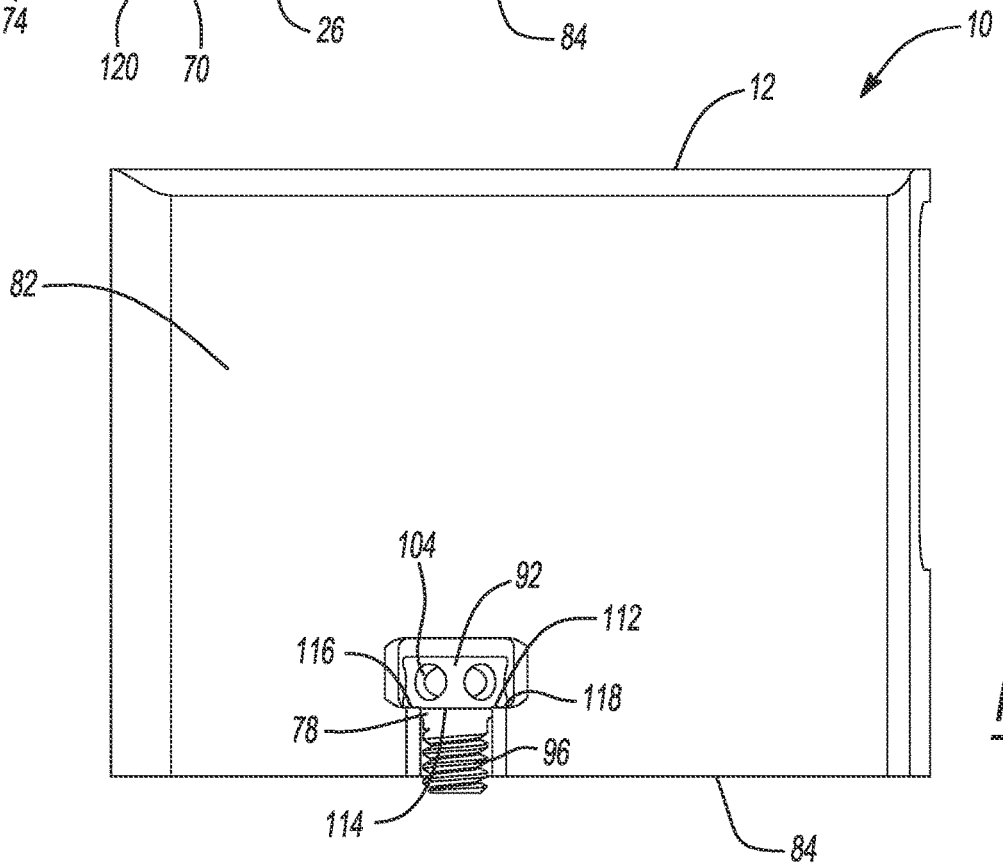
FIG. 5 is a side view of the optical sight in FIG. 2 accommodating an example fastener according to the present disclosure.
Figure 9:
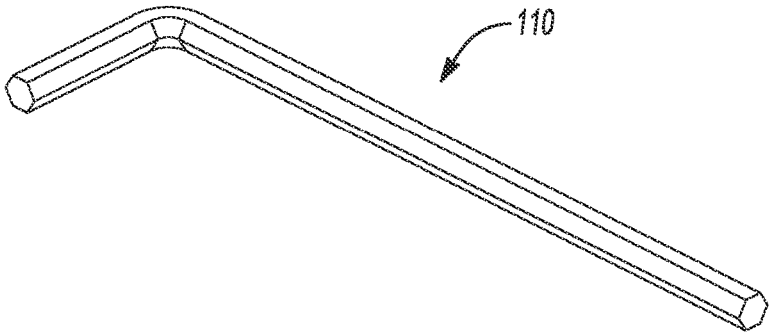

FIG. 9 is a perspective view of an example external tool used in conjunction with the fastener in FIG. 5.

Figure 10:
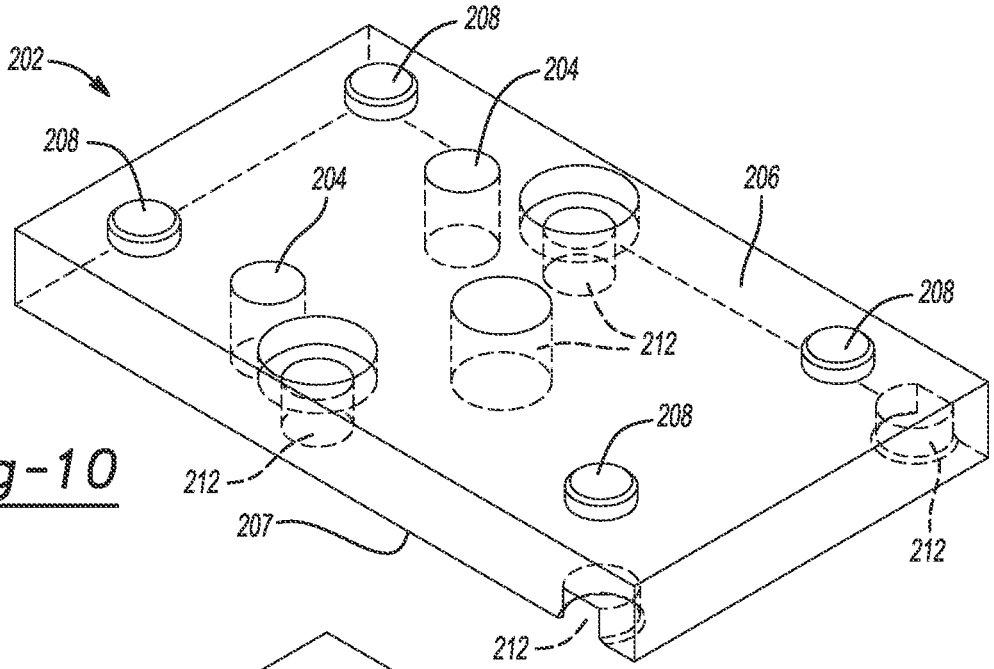

FIG. 10 is perspective view of an example mounting plate according to the present disclosure.

Figure 11:
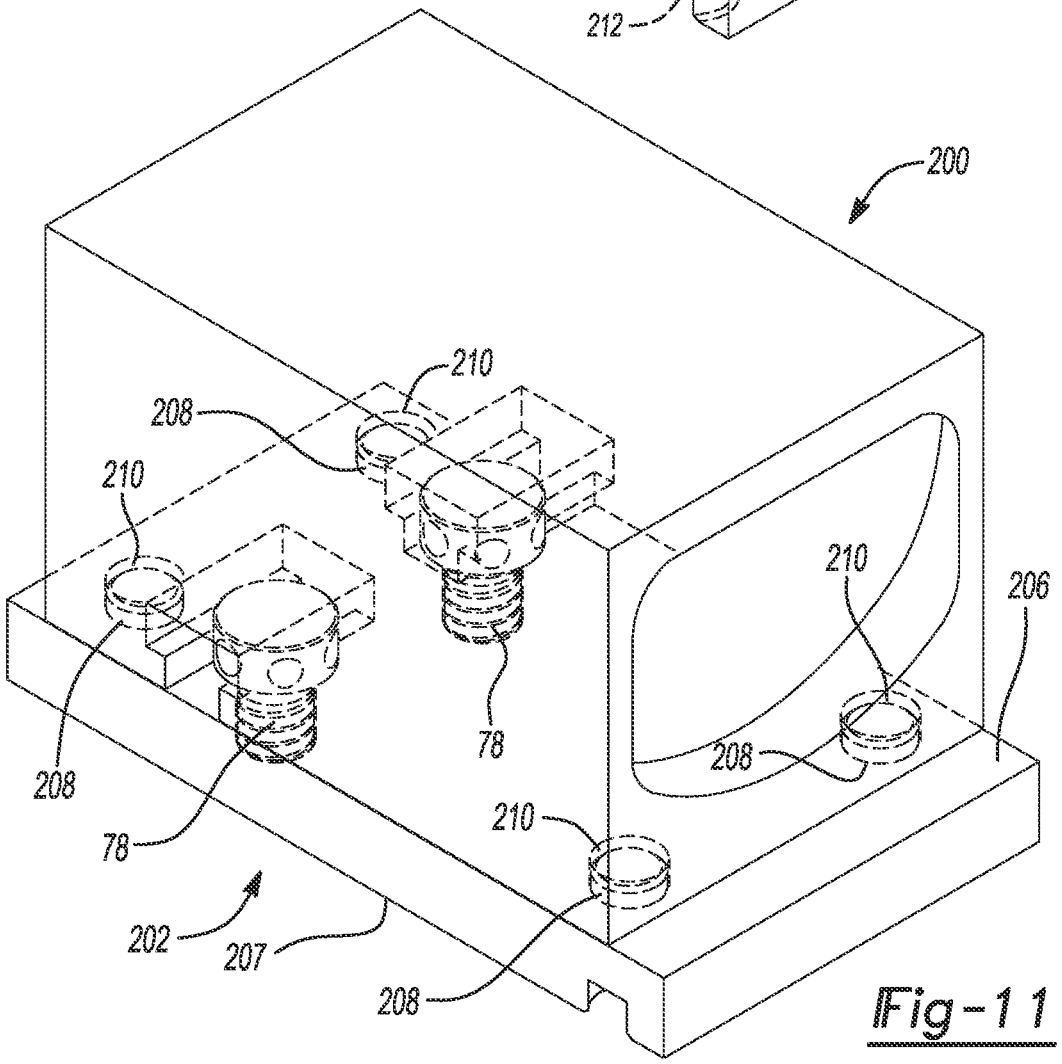

FIG. 11 is a perspective view of an example optical sight according to the present disclosure mounted on the mounting plate in FIG. 10.

Figure 12:
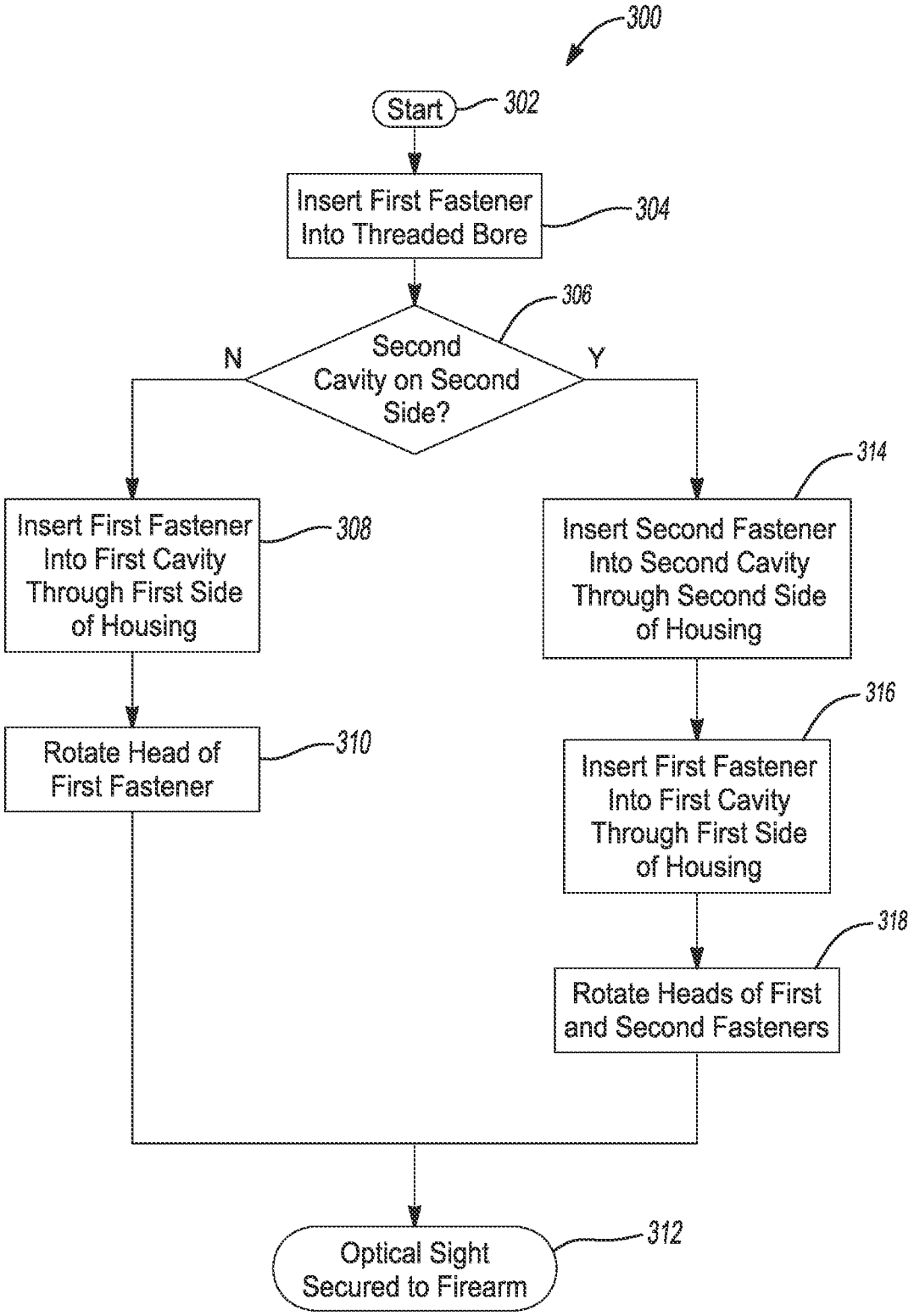

FIG. 12 is a flow chart of a method of attaching an optical sight to a firearm according to the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-8, an optical sight 10 is provided which may include a housing 12, an illumination assembly 16, and an optical element 18. Each of the illumination assembly 16 and optical element 18 may be supported by and attached to the housing 12 such that the housing 12 supports the illumination assembly 16 and optical element 18 relative to a firearm 20. When the housing 12 is mounted to the firearm 20, such as in FIG. 1, the illumination assembly 16 may cooperate with the optical element 18 to display a reticle 22 on the optical element 18 to facilitate alignment of a trajectory of the firearm 20 with a target (not shown). While the optical sight 10 may be used with various firearms, such as, for example, a bow, a rocket launcher, or a rifle, the optical sight 10 will be described hereinafter and shown in the drawings as being associated with a barrel 24 of a handgun, unless stated otherwise. In some embodiments, the optical sight 10 may be secured to a mounting plate which may then be secured to a firearm. An example embodiment utilizing a mounting plate is described in further detail below in reference to FIGS. 10 and 11.

Figure 3:
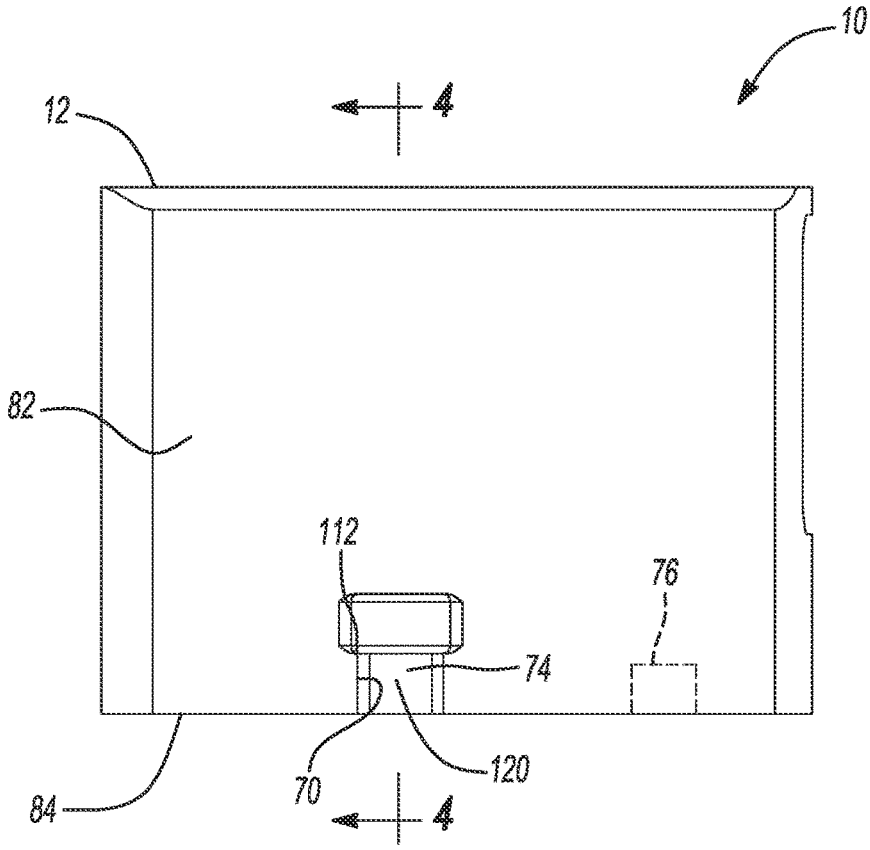
FIG. 3 is a side view of the optical sight in FIG. 2.
Figure 4:
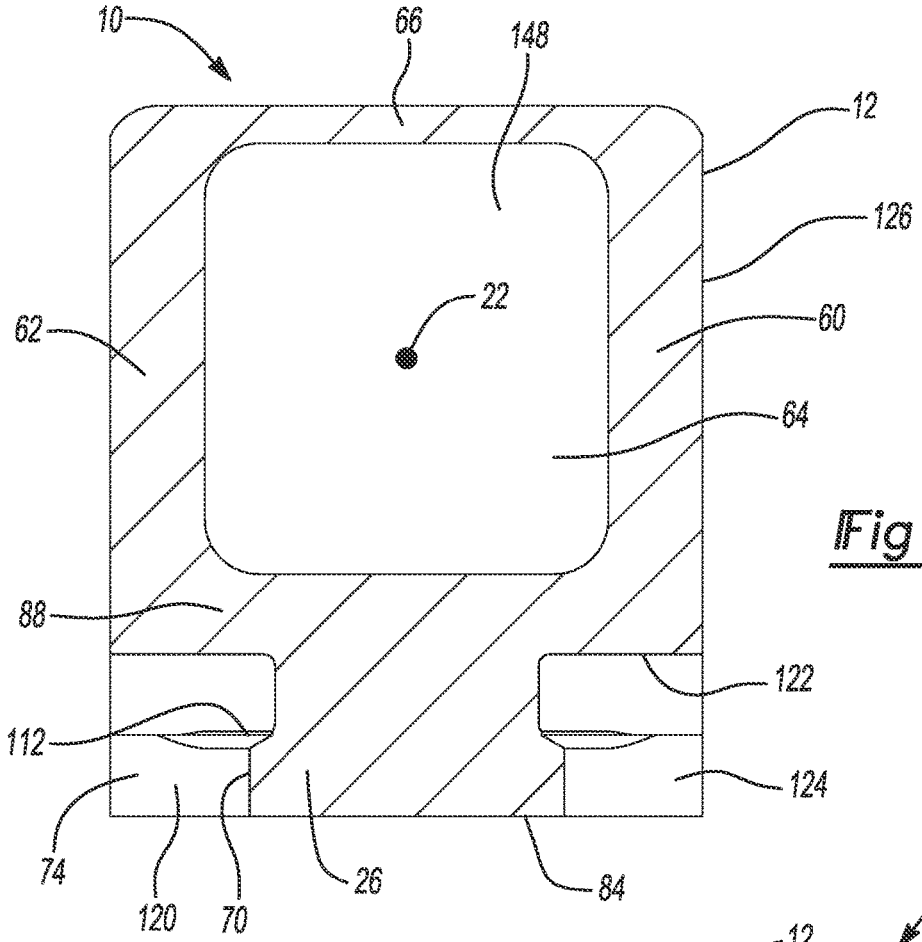
FIG. 4 is a cross-sectional view of the optical sight in FIG. 3 taken along line 4-4.

The housing 12 may include a base 26, a pair of sidewalls 62 extending from the base 26, an opening 64, and a cross member 66 extending generally over the opening 64 and between the sidewalls 62, as shown in FIGS. 2-4. The sidewalls 62 may be formed at a substantially ninety-degree angle relative to the base 26 and may extend a predetermined distance above the opening 64. The opening 64 may accommodate the optical element 18 therein.

The housing 12 may be formed of a one-piece metal construction. Forming the housing 12 as a one-piece metal body allows the housing 12 to better withstand forces applied to the housing 12. In particular, forces applied to the sidewalls 62 of the housing 12 are directly transferred from the sidewalls 62 to the base 26. Such forces are therefore diverted away from the optical element 18, thereby protecting the optical element 18. Forming the housing 12 of a one-piece metal construction enhances the ability of the sidewalls 62 in transmitting forces from a distal end of each of the sidewalls 62 to the base 26.

The housing 12 may also include one or more slots 76, as shown in FIG. 3, which may be configured to house alignment projections (not shown) extending from the barrel 24 of the firearm 20 when the optical sight 10 is placed on the firearm 20. The alignment projections may extend from the firearm 20 or other mounting surface in a direction towards the optical sight 10 when the optical sight is mounted on the firearm 20. The alignment projections and the slots 76 may assist in aligning the optical sight 10 relative to the firearm 20 when the optical sight 10 is secured to the firearm 20.

The housing 12 includes a first surface 70 defining a first cavity 74 in the base 26 and/or sidewall 62 of the housing 12. The first cavity 74 may be shaped similarly to that of a standard screw. The first cavity 74 is configured such that a fastener 78 may be held in the first cavity 74, as shown in FIGS. 5 and 7. The first cavity 74 is accessible from both a first side 82 of the housing 12 and a bottom 84 of the housing 12. A portion 88 of the housing 12 may separate the first cavity 74 from the opening 64 of the housing 12, causing the first cavity 74 to be inaccessible from the opening 64. Therefore, the opening 64 may not be accessed through the first cavity 74, and instead may only be accessible from longitudinal ends of the housing 12.

Figure 6:
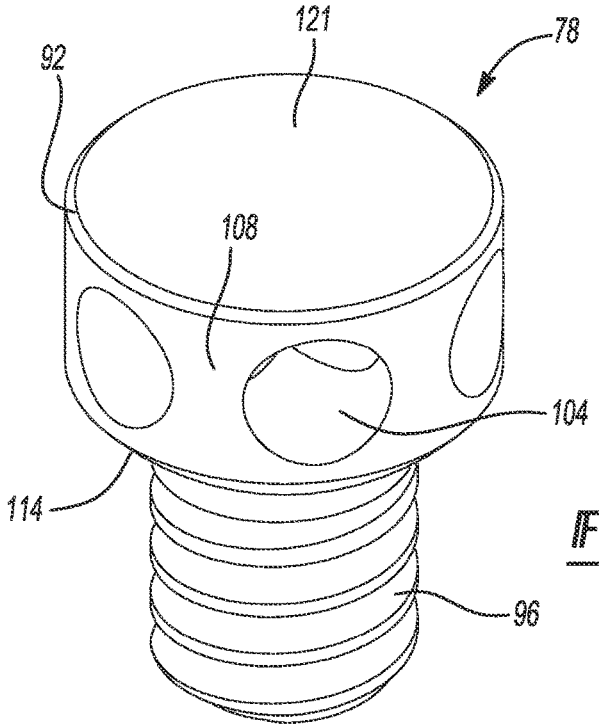
FIG. 6 is a perspective view of the fastener in FIG. 5.

The fastener 78, which is shown in FIG. 6, may be a threaded screw having a head 92 and a shaft 96. In some embodiments, such as the embodiment shown in FIG. 6, the fastener 78 may be a capstan screw. The fastener 78 may comprise a metal, or any other suitable material. In some embodiments, the fastener 78 may comprise 17-4 stainless steel. A top surface 121 of the head 92 of the fastener 78 may be a substantially flat surface. In some embodiments, the top surface 121 of the head 92 of the fastener may be curved. The head 92 of the fastener 78 may have a diameter of 0.226 inches in some embodiments.

The shaft 96 may be externally threaded in such a way that the fastener 78 may be screwed into a threaded bore 100 on the firearm 20. In some embodiments, the shaft 96 may have a thread size of 6-32. In some embodiments, the shaft 96 may have a thread size of M4, or any other suitable thread size. In some embodiments, the shaft 96 may be threaded in such a way that the fastener 78 may be coupled to a threaded bore of a mounting plate, which will be discussed in further detail below in reference to FIGS. 10 and 11.

The head 92 of the fastener 78 may include a first aperture 104 radially extending toward a longitudinal axis of the fastener 78 from a side exterior surface 108 of the head 92 of the fastener 78. The head 92 of the fastener 78 may include a second aperture (not shown) opposite the first aperture 104 radially extending toward a longitudinal axis of the fastener 78 from the side exterior surface 108 of the head 92 of the fastener 78. In some embodiments, the head 92 of the fastener 78 may include further apertures radially extending toward a longitudinal axis of the fastener 78 from a side exterior surface 108 of the head of the fastener 78. In some embodiments, the head 92 of the fastener 78 may comprise six apertures radially extending toward a longitudinal axis of the fastener 78. The apertures of the head 92 of the fastener 78 may be evenly spaced around the circumference of the head 92 of the fastener 78. In some embodiments, the first aperture 104 and the second aperture may instead be a continuous aperture extending across the entirety of the head 92 of the fastener 78. A diameter of the first aperture 104 and/or further apertures in the head 92 of the fastener 78 may be 1/16 of an inch in some embodiments.

The first aperture 104, the second aperture, and any further apertures may be configured to receive an external tool 110 therein, such as the external tool 110 shown in FIG. 9. The external tool 110 may improve leverage to allow easier rotation of the fastener 78 while the fastener is being secured in the threaded bore 100. In some embodiments, the external tool 110 may be a hex key. In some embodiments, the external tool 110 may be a 1/16 of an inch hex key. The external tool 110 may be configured to measure a torque applied to the fastener 78 when the fastener 78 is being tightened by use of the external tool 110. The side exterior surface 108 of the head 92 of the fastener 78 may be knurled to allow easier rotation of the fastener 78 by a hand of an operator tightening the fastener 78. In some embodiments, the head 92 of the fastener 78 may be round. In some embodiments, the head 92 of the fastener 78 may be hexagonal or another suitable shape.

When the fastener 78 is placed within the first cavity 74, such as in FIGS. 5 and 7, the head 92 of the fastener 78 may be supported by the first surface 70. This support may be provided by a platform 112 of the first surface 70, which may contact an underside 114 of the head 92 of the fastener 78 when the fastener 78 is placed in the first cavity 74. The platform 112 may include a first face 116 and a second face 118 on opposing sides of a space 120 of the first cavity 74 configured to accommodate the shaft 96 of the fastener 78 when the fastener 78 is disposed within the first cavity 74. The platform 112 may act as a shelf upon which the head 92 of the fastener 78 may abut when the fastener 78 is inserted into the first cavity 74. In some embodiments, the platform 112 may be circular in shape. In some embodiment, a diameter of the platform may be of 1/4 of an inch. The head 92 of the fastener 78 may be accessible from the first side 82 of the housing 12 when the fastener 78 is disposed in the housing 12.

The space 120 which allows the shaft 96 of the fastener 78 to extend through the bottom 84 of the housing 12 may extend through the platform 112, such that the shaft 96 extends through the bottom 84 of the housing 12 when the head 92 of the fastener 78 is supported by the platform 112. The first cavity 74 is configured such that the shaft 96 of the fastener 78 may be inserted into the threaded bore 100 of the firearm 20 when the fastener 78 is disposed in the first cavity 74, such as in FIG. 7. When the shaft 96 is secured within the threaded bore 100, the fastener 78 secures the optical sight 10 to the firearm 20, mounting plate, or other element including the threaded bore.

In some embodiments, the housing 12 may also include a second surface 122 defining a second cavity 124, such as the embodiment shown in FIG. 4. The second surface 122 may be substantially similar to the first surface 70 described above. The second cavity 124 may be substantially similar to the first cavity 74 described above. In some embodiments, the second cavity 124 may be accessible from the first side 82 of the housing 12 and the bottom 84 of the housing 12. In some embodiments, the second cavity 124 may be accessible from a second side 126 of the housing 12 and the bottom 84 of the housing 12. Another fastener 78 may be held in the second cavity 124 in a similar manner to the way the fastener 78 is held in the first cavity 74 as described above.

More than two surfaces defining cavities may be included in the housing 12 in some embodiments. Further fasteners 78 may be held in the further cavities.

The first cavity 74 may be configured to prevent access to at least a portion of a top surface 121 of the fastener 78 from above when the fastener 78 is placed within the first cavity 74. Restricting access to the fastener 78 from above may allow elements of the optical sight 10 to be placed above the fastener 78. For example, such a configuration may allow for accommodating a larger optical element which extends above the first cavity 74. Such a restriction on access to the fastener 78 from above may also allow the opening 64 of the housing 12 to longitudinally extend above the location of the fastener 78. Such an extended opening allows the illumination assembly 16 disposed within the housing 12 and to be protected from the environment, which is discussed in further detail below.

A fastening system for an optical sight as described herein provides a further benefit in that the layout of the fasteners may match the layout of the fasteners used in prior-art optical sights. Thus, operators may be able to transition to an optical sight having the benefits described in this disclosure without needing to modify their firearm, such as installing a new mounting plate or machining new bores into the firearm, to attach the optical sight to the firearm. Similarly, if an operator already utilizes a mounting plate for mounting an optical sight to a firearm, the mounting plate may continue to be used with the improved optical sight described in this disclosure, so long as the previously used optical sight utilized the same fastener layout as the improved optical sight.

The illumination assembly 16 may include a circuit board 130, a light source 132, a photo detector 134, and a power source 136. The circuit board 130 may be fixedly attached to the base 26 of the housing 12 via epoxy or the like. The circuit board 130 may support the light source 132 and photo detector 134. In one configuration, such as in FIG. 8, the light source 132 and photo detector 134 are encapsulated on the circuit board 130 using a transparent epoxy or other coating. In another configuration, the light source 132 may be disposed proximate to the circuit board 130 and may be attached thereto while the photo detector 134 is disposed adjacent to the optical element 18. Positioning the photo detector 134 proximate to the optical element 18 allows light to be collected from multiple angles and be transmitted to the photo detector 134 via the optical element 18.

Regardless of the particular location of the photo detector 134, the light source 132 and photo detector 134 may be selectively controlled by the circuit board 130, whereby the photo detector 134 selectively causes the light source 132 to illuminate in response to ambient light conditions. Illumination of the light source 132 causes the light source 132 to direct light generally toward the optical element 18 to display the reticle 22 on the optical element 18, as shown in FIG. 4. In some embodiments, the light source 132 may be a low emitting diode (LED).

The base 26 may also include a recess 42 configured to allow the illumination assembly 16 to direct light generally from the base 26 of the housing 12 toward the optical element 18. The recess 42 may be formed generally between the optical element 18 and a frontal lens 148 located at an operator-end of the opening 64.

As shown in FIG. 8, the circuit board 130, the light source 132, and the photo detector 134 may generally be disposed within the housing 12 between the frontal lens 148 and the optical element 18. The circuit board 130, light source 132, and photo detector 134 are protected from environmental conditions by the frontal lens 148 that may be disposed generally between a first end of the opening of the housing 12 on one side and the circuit board 130, the light source 132, and the photo detector 134 on another side.

The frontal lens 148 may be sealed against the housing 12 by an epoxy or other suitable adhesive. Positioning epoxy between the frontal lens 148 and the housing 12 prevents debris from entering the housing 12 and contacting components of the illumination assembly 16. Because the optical sight 10 may be used on a firearm by law enforcement and/or military personnel, the optical sight 10 may be subjected to extreme weather conditions such as, for example, rain, wind, and ice. The configuration of the circuit board 130, the light source 132, and the photo detector 134 being disposed within the housing 12 and between the optical element 18 and the frontal lens 148 helps prevent such weather conditions from reaching the circuit board 130, the light source 132, and the photo detector 134 and therefore improves the ability of the light source 132 in consistently providing light to the optical element 18 and displaying the reticle 22 thereon.

The power source 136 may be in electrical communication with at least one of the circuit board 130, light source 132, and photo detector 134, which may occur, for example, via a contact strip. In one configuration, the power source 136 may be a battery having a generally circular shape. The battery may be received within a recess 144 of the housing 12 and may be held within the recess 144 by a magnet 146, which allows for removal and replacement of the battery when the battery requires replacement.

The optical element 18 may include a doublet lens having a first lens 170, a second lens 172, and a dichroic coating formed on at least one of the first and second lenses 170, 172 to allow light from the light source 132 to be reflected thereon. Coating one of the lenses 170, 172 with the dichroic coating allows the light source 132 to generate the reticle 22 in an area generally between the lenses 170, 172 and therefore allows the reticle 22 to be displayed on the optical element 18. The lenses 170, 172 may be shaped to conform with the shape of the opening 64. Once the optical element 18 is installed in the housing 12, upper surfaces 176, 178 of the lenses 170, 172 may be positioned generally adjacent to a bottom surface 68 of the cross member 66. The lenses 170, 172 may be spherical lenses.

Another embodiment of an optical sight in accordance with the present disclosure will be described with reference to FIGS. 10 and 11. In this embodiment, an optical sight 200 may be mounted to a mounting plate 202, which may then be mounted to a firearm. The mounting plate 202 may be mounted directly on a barrel of a firearm but may also be attached to a rail extending from a firearm or another extension from a firearm. The optical sight 200 may be configured in a similar fashion to the optical sight 10 described in the embodiment above.

The mounting plate 202 may include at least one threaded bore 204, an upper surface 206, and a lower surface 207. The at least one threaded bore 204 may be configured to receive a fastener 78 in a similar fashion to the threaded bore 100 described in the embodiment shown in FIGS. 1-8. The upper surface 206 of the mounting plate 202 may be a generally flat surface, but may vary in order to mate with a bottom surface of an optical sight. The lower surface 207 may have a generally arcuate shape to accommodate an arcuate shape of a firearm barrel. In another configuration, the lower surface 207 of the mounting plate 202 may include a generally flat or planar surface to accommodate a barrel having a generally flat or planar top surface. The mounting plate 202 may also include one or more alignment projections 208 extending from the upper surface 206 of the mounting plate 202 which may align with alignment slots 210 of the optical sight 200 to assist in aligning the optical sight 200 in the proper position when attached.

The mounting plate 202 may also include one or more mounting points 212 which are configured to be the fastening locations for securing the mounting plate 202 to a firearm. The mounting points 212 may be apertures which allow fasteners, such as threaded screws, to pass through the mounting plate 202 to the firearm. The mounting points 212 may also include slots which are configured to accommodate alignment projections extending from the firearm.

When the fasteners 78 are housed within cavities of the optical sight 200 and secured within the at least one threaded bore 204, the optical sight 200 may then be secured to the mounting plate 202. The layout of the at least one threaded bore 204 may be identical to the layout of threaded bores of a firearm, such as the threaded bores 100 described above with reference to FIGS. 1-8.

Maintaining a common layout throughout various mounting surfaces allows an optical sight to be installed on any of the surfaces. Thus, the optical sight may be installed on a variety of firearms without the need for extensive modifications to install the optical sight.

With continued reference to FIGS. 1-8 and 12, a method 300 of attaching the optical sight 10 to the firearm 20 will be described in detail. At the start at step 302 of the method 300, the optical sight 10 is not attached to the firearm 20.

At step 304 of the method 300, an operator of the firearm 20 may partially insert the fastener 78 into the threaded bore 100 of the barrel 24 of the firearm 20. The fastener 78 may only be inserted to an extent which allows the fastener 78 to stand vertically out of the threaded bore 100. For example, inserting the fastener 78 by a quarter of a thread of the threaded shaft 96 may be sufficient to allow the fastener 78 to stand vertically out of the threaded bore 100. At a maximum, the fastener 78 may be inserted to an extent such that the housing 12 may be placed in a position such that the fastener 78 is accommodated in the first cavity 74 with the fastener 78 partially secured to the threaded bore 100. In other words, the shaft 96 of the fastener 78 may be inserted into the threaded bore 100 only to an extent which allows the platform 112 to remain below the head 92 of the fastener 78 when the housing 12 is placed in a position to accommodate the fastener 78 in the first cavity 74.

After the fastener 78 has been inserted into the threaded bore 100 at the step 302, the method proceeds to conditional step 306, which depends on whether the optical sight includes more than one cavity and cavities are accessible from different sides of the optical sight, such as in the embodiment shown in FIG. 4.

If there is not more than one cavity and/or the cavities are not accessible from different sides of the optical sight at the conditional step 306, the method 300 proceeds to step 308. At the step 308, the housing 12 is placed in a position which accommodates the fastener 78 in the first cavity 74. This may be accomplished by moving the optical sight 10 into a position such that the head 92 of the fastener 78 is inserted into the first cavity 74 through the first side 82 of the housing. When the first cavity 74 is accommodating the fastener 78, the platform 112 is below the head 92 of the fastener 78 and the shaft 96 extends through the space 120 of the first cavity 74. In this position, the head 92 of the fastener 78 may not be accessible from above the fastener 78.

Alternatively, in embodiments in which an optical sight includes more than one cavity and multiple cavities are accessible from the same side of the optical sight, then a second fastener, which will be inserted into a cavity on the same side as the first cavity 74, may be partially inserted into a second threaded bore prior to being inserted into its respective cavity, in a similar fashion to the fastener 78 in the step 304. When the optical sight 10 is placed in a position which accommodates the fastener 78 in the first cavity 74 at the step 308, the housing may also accommodate the second fastener in its respective cavity by inserting the head of the second fastener into the second cavity through the side of the housing, in a similar manner to the insertion of the fastener 78 into the first cavity 74.

The fastener 78 may then be rotated in a tightening direction by turning the head 92 of the fastener 78 at step 310. This turning of the head 92 of the fastener 78 may be accomplished by a hand of an operator contacting the side 108 of the head 92 of the fastener 78 and rotating the head 92 of the fastener 78. In some embodiments, which include at least the first aperture 104 on the head 92 of the one or more fasteners 78, the external tool 110 may be used to tighten the one or more fasteners 78. The external tool 110 may be inserted into the first aperture 104 (or further apertures) of the head 92 of the fastener 78 and rotated by pushing or pulling to cause the head 92 of the fastener 78 to rotate. The fastener 78 may be tightened until a predetermined torque is applied to the fastener 78. Torque applied to the fastener 78 may be measured by the external tool 110.

Rotation of the fastener 78 may continue until the optical sight 10 is secured to the firearm 20 at step 312, which ends the method 300 of attaching the optical sight 10 to the firearm 20. The point at which the optical sight 10 is secured to the firearm 20 may be determined by a torque measurement detected during tightening of the fastener 78 meeting a torque specification or may be determined by visual inspection by an operator of the firearm 20.

If at the conditional step 306, it is determined that the optical sight includes more than one cavity and the cavities are accessible from different sides of the optical sight, then the method proceeds to step 314. At the step 314, a second fastener may be placed into the second cavity 124 of the housing 12 prior to the optical sight 10 being placed in the position which accommodates the fastener 78 in the first cavity 74 at step 316. The step 316 may occur prior to the step 314 in some embodiments. As the optical sight 10 is placed into the position to accommodate the fastener 78 in the first cavity 74, the second fastener will be placed in a position adjacent to a second threaded bore (not shown) such that the second fastener may then be rotated to secure the second fastener to the second threaded bore.

The fastener 78 and second fastener may then be rotated in a tightening direction by turning the head 92 of the fastener 78 and second fastener at step 318. This turning of the head 92 of the fastener 78 and second fastener may be accomplished by a hand of an operator contacting the side 108 of the head 92 of the fastener 78 and second fastener and rotating the head 92 of the fastener 78 and second fastener. In some embodiments, which include at least the first aperture 104 on the head 92 of the fastener 78 and second fastener, the external tool 110 may be used to tighten the fastener 78 and second fastener. The external tool 110 may be inserted into the first aperture 104 (or further apertures) of the head 92 of the fastener 78 and second fastener and rotated by pushing or pulling to cause the head 92 of the fastener 78 and second fastener to rotate. The fastener 78 and second fastener may be tightened until a predetermined torque is applied to the fastener 78 and second fastener. Torque applied to the fastener 78 and second fastener may be measured by the external tool 110.

The second fastener housed in the second cavity 124 may be rotated contemporaneously with the rotation of the fastener 78 housed in the first cavity 74, such that the fasteners 78 remain at similar levels of insertion throughout the tightening of the fasteners 78. Rotating the fasteners 78 contemporaneously allows the optical sight 10 to remain generally aligned with the barrel 24 of the firearm 20 during attachment, which may assist in properly aligning the optical sight 10 to the firearm 20.

Rotation of the fastener 78 and second fastener may continue until the optical sight 10 is secured to the firearm 20 at step 312, which ends the method 300 of attaching the optical sight 10 to the firearm 20. The point at which the optical sight 10 is secured to the firearm 20 may be determined by a torque measurement detected during tightening of the fastener 78 and second fastener meeting a torque specification or may be determined by visual inspection by an operator of the firearm 20.

The above-described method 300 may be similarly performed with alternative embodiments of the optical sight, including embodiments utilizing a mounting plate, such as the embodiment shown in FIGS. 10 and 11. In such an embodiment, the one or more fasteners are inserted into the threaded bores of the mounting plate to secure the optical sight to the mounting plate.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An optical sight comprising:

a housing, the housing including:

a first cavity having a first surface, the first cavity accessible from a first opening on a first side of the housing and a second side of the housing, the first opening extending continuously between the first side and the second side, the first surface including a portion opposite the second side of the housing such that the first cavity is inaccessible from a third side of the housing opposite the second side of the housing, the first surface including another portion opposite the first side of the housing such that the first cavity is inaccessible from a fourth side of the housing opposite the first side of the housing, the first cavity accommodating a first threaded fastener therein such that a head of the first threaded fastener is supported by the first surface and such that a threaded shaft of the first threaded fastener extends through the second side of the housing; and a second opening extending along a longitudinal axis of the housing; and an optical element supported by the housing and disposed within the second opening of the housing.

2. The optical sight of claim 1, wherein the first cavity is configured such that the head of the first threaded fastener is accessible from the first side of the housing when the first threaded fastener is within the first cavity.

3. The optical sight of claim 2, wherein an exterior side surface of the head of the first threaded fastener includes a first aperture.

4. The optical sight of claim 3, wherein the exterior side surface of the head of the first threaded fastener includes a second aperture, wherein the second aperture is opposite the first aperture.

5. The optical sight of claim 1, wherein a portion of the housing separates the first cavity from the second opening of the housing.

6. The optical sight of claim 1, wherein the first cavity is configured such that a top surface of the head of the first threaded fastener is inaccessible from the third side of the housing when the first threaded fastener is in the first cavity.

7. The optical sight of claim 1, wherein the housing further includes a second cavity having a second surface, the second cavity accessible from a fourth side of the housing and the second side of the housing, the second surface configured such that the second cavity is inaccessible from the third side of the housing, the second cavity configured to accommodate a second fastener therein such that a head of the second fastener is supported by the second surface and such that a shaft of the second fastener extends through the second side of the housing, wherein the fourth side of the housing is the same as the first side of the housing or different from the first side of the housing.

8. The optical sight of claim 7, wherein the second cavity is configured such that the head of the second fastener is accessible from the fourth side of the housing when the second fastener is placed within the second cavity.

9. The optical sight of claim 8, wherein a side exterior surface of the head of the second fastener includes a first aperture.

10. The optical sight of claim 9, wherein the side exterior surface of the head of the second fastener includes a second aperture, wherein the second aperture is opposite the first aperture.

11. The optical sight of claim 7, wherein the fourth side of the housing is opposite the first side of the housing.

12. The optical sight of claim 7, wherein a portion of the housing separates the second cavity from the second opening of the housing.

13. The optical sight of claim 7, wherein the second cavity is configured such that a top surface of the head of the second fastener is inaccessible from the third side of the housing when the second fastener is placed in the second cavity.

14. The optical sight of claim 1, wherein the optical sight further comprises a reticle displayed on the optical element.

15. The optical sight of claim 14, wherein the reticle is provided by a light source.

16. The optical sight of claim 15, wherein the light source is disposed within the second opening.

* * * * *